US011753733B2

(12) United States Patent
Tarutani et al.

(10) Patent No.: US 11,753,733 B2
(45) Date of Patent: Sep. 12, 2023

(54) METHOD FOR PRODUCING HIGH-PURITY ELECTROLYTIC COPPER

(71) Applicant: MITSUBISHI MATERIALS CORPORATION, Tokyo (JP)

(72) Inventors: Yoshie Tarutani, Naka (JP); Kenji Kubota, Naka (JP); Kiyotaka Nakaya, Naka (JP); Isao Arai, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 41 days.

(21) Appl. No.: 16/617,574

(22) PCT Filed: Jun. 1, 2018

(86) PCT No.: PCT/JP2018/021228
§ 371 (c)(1),
(2) Date: Nov. 27, 2019

(87) PCT Pub. No.: WO2018/221734
PCT Pub. Date: Dec. 6, 2018

(65) Prior Publication Data

US 2020/0181788 A1 Jun. 11, 2020

(30) Foreign Application Priority Data

Jun. 1, 2017 (JP) ..... 2017-109244
Jun. 2, 2017 (JP) ..... 2017-110418
May 21, 2018 (JP) ..... 2018-097318
May 21, 2018 (JP) ..... 2018-097319

(51) Int. Cl.
*C25C 1/12* (2006.01)
*C22C 9/00* (2006.01)

(52) U.S. Cl.
CPC . *C25C 1/12* (2013.01); *C22C 9/00* (2013.01)

(58) Field of Classification Search
CPC .... C25C 1/12; C25C 1/00; C25C 5/00; C25C 5/02; C22C 9/00; C25D 3/38
See application file for complete search history.

(56) References Cited

U.S. PATENT DOCUMENTS 3,617,451 A * 11/1971 Slominski ..... C25D 3/38 205/217
4,792,369 A 12/1988 Ogata et al.
9,435,016 B2 * 9/2016 Sakurai ..... H01B 1/026
2002/0011416 A1 * 1/2002 Landau ..... C25D 7/12 205/297
2004/0249177 A1 * 12/2004 Wang ..... C25D 3/38 549/563
2008/0223728 A1 9/2008 Shindo et al.
2013/0319584 A1 * 12/2013 Sakurai ..... C22F 1/08 148/683
2013/0334057 A1 * 12/2013 Watanabe ..... C25C 1/12 205/296
2016/0355939 A1 * 12/2016 Thorum ..... C25D 3/38
2017/0088963 A1 3/2017 Tarutani et al.
2019/0203369 A1 * 7/2019 Si ..... C07C 215/24

FOREIGN PATENT DOCUMENTS

CN 101985700 A 3/2011
CN 105814233 A 7/2016
JP 63-203784 A 8/1988
JP 02-185990 A 7/1990
JP 02-294495 A 12/1990
JP 03-140489 A 6/1991
JP 04-365889 A 12/1992
JP 06-173063 A 6/1994
JP 08-000990 B2 1/1996
JP 2001-123289 A 5/2001
JP 2004-315849 A 11/2004
JP 2005-307343 A 11/2005
JP 2005-533187 A 11/2005
JP 4620185 B2 1/2011
JP 4706081 B2 * 6/2011
JP 2014-015677 A 1/2014
JP 2017-043834 A 3/2017
JP 2017-066514 A 4/2017
WO 2004/011691 A1 2/2004
WO 2016/052727 A1 4/2016
WO WO-2016052727 A1 * 4/2016 ..... C25C 1/12
WO 2017/033694 A1 3/2017

OTHER PUBLICATIONS

National Center for Biotechnology Information, PubChem Compound Summary for CID 67519, 1H-Tetrazole, PubChem, Created Mar. 26, 2005, https://pubchem.ncbi.nlm.nih.gov/compound/1H-Tetrazole. Accessed May 26, 2022. (Year: 2005).*

(Continued)

*Primary Examiner* — Alexander W Keeling
*Assistant Examiner* — Mofoluwaso S Jebutu
(74) *Attorney, Agent, or Firm* — Locke Lord LLP; James E. Armstrong, IV; Nicholas J. DiCeglie, Jr.

(57) ABSTRACT

In a method for producing high-purity electrolytic copper, a first additive (A) containing an aromatic ring of a hydrophobic group and a polyoxyalkylene group of a hydrophilic group, a second additive (B) formed of polyvinyl alcohols, and a third additive (C) formed of tetrazoles are added to a copper electrolyte, copper electrolysis is performed by controlling each concentration of the first additive (A), the second additive (B), and the third additive (C), a current density and a bath temperature, and accordingly, electrolytic copper in which a concentration of Ag is less than 0.2 mass ppm, a concentration of S is less than 0.07 mass ppm, a concentration of all impurities is less than 0.2 mass ppm, and an area ratio of crystal grains having an average crystal grain misorientation (referred to as a GOS value) exceeding 2.5° is 10% or less is obtained.

8 Claims, No Drawings

(56) References Cited

OTHER PUBLICATIONS

T. Konkova, S. Mironov, A. Korznikov, S.L. Semiatin, On the room-temperature annealing of cryogenically rolled copper, Materials Science and Engineering: A, vol. 528, Issue 24, 2011, pp. 7432-7443, (Year: 2011).*

International Search Report dated Aug. 21, 2018, issued for PCT/JP2018/021178 and English translation thereof.

International Search Report dated Aug. 21, 2018, issued for PCT/JP2018/021228 and English translation thereof.

Supplementary European Search Report dated Jan. 27, 2021, issued for European Patent Application No. 18809582.2.

Yi Guangbin, "Mechanism on Warping and Microstructure and Mechanical Properties of Electrolytic Copper Foils," China doctoral dissertation full text database, Engineering Science and Technology I, Chapters 2-4, May 15, 2015, pp. 21-92. (cited in the Dec. 2, 2020 Office Action issued for CN201880015294.1, See English translation of the Dec. 2, 2020 CN OA for concise explanation(s) of the relevance).

Office Action dated Dec. 2, 2020, issued for Chinese Patent Application No. 201880015294.1 and English translation thereof.

Hiroaki Nakano et al., "Synergistic Effect of Additives on Morphology and Texture of Copper Deposited from Electrorefining Solution," Journal of MMIJ vol. 127, p. 662-666(2011).

List of the papers of Journal of MMIJ vol. 127, No. 10-11. (Indicating publication date of Nakano NPL).

* cited by examiner

METHOD FOR PRODUCING HIGH-PURITY ELECTROLYTIC COPPER

TECHNICAL FIELD

The present invention relates to a method for producing high-purity electrolytic copper in which disorder of crystal lattices is slight and the amount of impurities between crystal lattices is small.

Priority is claimed on Japanese Patent Application No. 2017-109244, filed on Jun. 1, 2017, Japanese Patent Application No. 2017-110418, filed on Jun. 2, 2017, Japanese Patent Application No. 2018-097319, filed on May 21, 2018, and Japanese Patent Application No. 2018-097318, filed on May 21, 2018, the content of which is incorporated herein by reference.

BACKGROUND ART

Main impurities contained in electrolytic copper are Ag, Fe, Ni, Al, and the like in addition to gas components (O, H, S, C, Cl, and the like), and the impurity having the greatest amount among these is Ag. This depends on eutectoid of Ag, which is a noble metal than copper, with copper, in an electrodeposition mechanism of copper. In order to prevent this eutectoid of Ag, a method of adding chloride ions to the electrolyte to remove Ag ions in the electrolyte as silver chloride particles has been performed, but the Ag ions in the electrolyte cannot be completely removed by the chloride ions, and accordingly, a method of performing electrolysis in two stages is performed, in order to obtain copper having a higher purity. For example, Patent Document 1 discloses a method of performing electrolysis in two stages of collecting copper precipitated by the electrolysis of a copper sulfate aqueous solution, setting this as a positive electrode, and performing purification by re-electrolysis at a low current density of 100 $A/m^2$ or less in a copper nitrate aqueous solution. However, the producing method of performing the electrolysis of a copper sulfate bath and the electrolysis of a copper nitrate bath in two stages requires cost and effort.

Therefore, a method of reducing impurities by using a specific additive is known. For example, Patent Document 2 discloses a method for producing an electrolytic copper foil having increased mechanical properties and cathode adhesion by adding a polyoxyethylene surfactant such as polyethylene glycol (PEG) to a copper sulfate electrolyte including chloride ions, glue, and active sulfur components. Patent Document 3 discloses a method for producing high-purity electrolytic copper in which a copper surface is smooth and a content of Ag or S impurities is small, by adding a smoothing agent such as polyvinyl alcohol (PVA) and a slime promoting agent such as PEG. However, the content of Ag in the electrolytic copper precipitated on a cathode cannot be sufficiently decreased only by adding PEG or PVA to the electrolyte.

In order to solve this problem, a technology for producing high-purity electrolytic copper in which a Ag concentration and a S concentration are extremely small, by adding an additive including a main agent containing a hydrophobic group of an aromatic ring and a hydrophilic group of a polyoxyalkylene group, and a stress relaxation agent formed of PVA or a derivative thereof (Patent Document 4), and a method for producing high-purity electrolytic copper in which a Ag concentration and a S concentration are extremely small, by using a main agent formed of an ethylene oxide adduct having 1 to 2 of an IOB value in an organic conceptual view and 150 to 20000 of an average molecular weight, and a stress relaxation agent such as PVA having 2.0 to 9.5 of an IOB value and 6000 to 150000 of an average molecular weight (Patent Document 5) have been proposed by the present applicant.

CITATION LIST

Patent Document

[Patent Document 1] Japanese Examined Patent Application, Second Publication No. H8-000990

[Patent Document 2] Japanese Unexamined Patent Application, First Publication No. 2001-123289

[Patent Document 3] Japanese Unexamined Patent Application, First Publication No. 2005-307343

[Patent Document 4] Japanese Unexamined Patent Application, First Publication No. 2017-043834

[Patent Document 5] Japanese Unexamined Patent Application, First Publication No. 2017-066514

DISCLOSURE OF INVENTION

Technical Problem

According to the technologies disclosed in Patent Documents 4 and 5, it is possible to produce electrolytic copper having a high purity in which the Ag concentration and the S concentration are extremely small (for example, 1 mass ppm or less). Meanwhile, in the producing of the electrolytic copper, it is important to decrease a concentration of impurities such as Ag or S included in the electrolytic copper and decrease electrodeposition defects. Electrodeposition defects are voids in the electrolytic copper, and in a case where electrodeposition defects are generated, the electrolyte is intruded into the voids, and the electrolyte components in the voids are mixed with the entire electrolytic copper when the electrolytic copper is dissolved or casted, and this causes a decrease in purity after the dissolving and casting. In addition, electrolytic copper with no warpage is preferable, and electrolytic copper with no warpage is required in the producing of electrolytic copper.

In the invention, it is found that it is possible to determine occurrence of warpage in electrolytic copper by setting an average crystal grain misorientation (referred to as a GOS (grain orientation spread) value) as an index. In the related art, the determination of warpage in electrolytic copper depends on visual observation, and accordingly, observation errors are unavoidable, but objective determination can be performed by setting a reference based on the GOS value as an index. The GOS value also relates to a concentration of impurities in electrolytic copper. Meanwhile, in the producing method of Patent Documents 4 and 5, the arrangement of orientations in the crystal grains of the electrolytic copper (reduction of misorientation in crystal grains) is not recognized. In the method for producing the electrolytic copper, it is possible to produce electrolytic copper in which warpage of an electrolytic copper does not occur and the amount of impurities such as Ag or S is decreased, by reducing misorientation in the crystal grains.

An object of the invention is to solve a problem of the related art in that the control of misorientation of crystal grains is not recognized, and to provide a method of producing electrolytic copper having a high purity in which misorientation of crystal grains is small and a concentration of all impurities such as Ag or S is extremely small.

Solution to Problem

The invention relates to a method of producing high-purity electrolytic copper obtained by solving the problem described above by the following configurations.

[1] A method for producing high-purity electrolytic copper, including: adding a first additive (A) containing an aromatic ring of a hydrophobic group and a polyoxyalkylene group of a hydrophilic group, a second additive (B) formed of polyvinyl alcohols, and a third additive (C) formed of tetrazoles to a copper electrolyte; and performing copper electrolysis by setting a concentration of the first additive (A) to be 10 mg/L to 500 mg/L, a concentration of the second additive (B) to be 1 mg/L to 100 mg/L, a concentration of the third additive (C) to be 0.01 mg/L to 30 mg/L, a concentration ratio (B/A) of the second additive (B) to the first additive (A) to be 0.1 to 0.8, and a concentration ratio (C/A) of the third additive (C) to the first additive (A) to be greater than 0 and 0.7 or less, and controlling a current density and a bath temperature to produce electrolytic copper in which a concentration of Ag is less than 0.2 mass ppm, a concentration of S is less than 0.1 mass ppm, a concentration of all impurities is less than 0.2 mass ppm, and an area ratio of crystal grains having an average crystal grain misorientation (referred to as a GOS value) exceeding 2.5° is 10% or less.

[2] The method for producing high-purity electrolytic copper according to [1], including: performing copper electrolysis by setting the current density to be 150 A/m$^2$ to 190 A/m$^2$ and the bath temperature to be 30° C. to 35° C. to produce electrolytic copper in which the concentration of Ag is less than 0.15 mass ppm, the concentration of S is less than 0.07 mass ppm, the concentration of all impurities is less than 0.2 mass ppm, and the area ratio of crystal grains having an average crystal grain misorientation (GOS value) exceeding 2.5° is 10% or less.

[3] The method for producing high-purity electrolytic copper according to [1] or [2], including: setting the concentration of the first additive (A) to be 40 mg/L to 200 mg/L, the concentration of the second additive (B) to be 10 mg/L to 50 mg/L, the concentration of the third additive (C) to be 0.1 mg/L to 25 mg/L, the concentration ratio (B/A) of the second additive (B) to the first additive (A) to be 0.1 to 0.65, and the concentration ratio (C/A) of the third additive (C) to the first additive (A) to be 0.001 to 0.5 to produce electrolytic copper in which the concentration of Ag is less than 0.1 mass ppm, the concentration of S is less than 0.02 mass ppm, the concentration of all impurities is less than 0.1 mass ppm, and the area ratio of crystal grains having an average crystal grain misorientation (GOS value) exceeding 2.5° is 8% or less.

[4] The method for producing high-purity electrolytic copper according to [1] or [2], including: setting the concentration of the second additive (B) to be 10 mg/L to 50 mg/L, the concentration of the third additive (C) to be 1 mg/L to 5 mg/L, the concentration ratio (B/A) of the second additive (B) to the first additive (A) to be 0.13 to 0.4, and the concentration ratio (C/A) of the third additive (C) to the first additive (A) to be 0.005 to 0.10 to produce electrolytic copper in which the concentration of Ag is less than 0.08 mass ppm, the concentration of S is less than 0.01 mass ppm, the concentration of all impurities is less than 0.1 mass ppm, and the area ratio of crystal grains having an average crystal grain misorientation (GOS value) exceeding 2.5° is 5% or less.

Advantageous Effects of Invention

According to the invention, it is possible to provide a method for producing electrolytic copper having a high purity in which misorientation of crystal grains is small and a concentration of all impurities such as Ag or S is extremely small.

BEST MODE FOR CARRYING OUT THE INVENTION

Hereinafter, the invention will be described in detail.

A producing method of the invention is a method for producing high-purity electrolytic copper of including: adding a first additive (A) containing an aromatic ring of a hydrophobic group and a polyoxyalkylene group of a hydrophilic group, a second additive (B) formed of polyvinyl alcohols, and a third additive (C) formed of tetrazoles to a copper electrolyte; and performing copper electrolysis by setting a concentration of the first additive (A) to be 10 mg/L to 500 mg/L, a concentration of the second additive (B) to be 1 mg/L to 100 mg/L, a concentration of the third additive (C) to be 0.01 mg/L to 30 mg/L, a concentration ratio (B/A) of the second additive (B) to the first additive (A) to be 0.1 to 0.8, and a concentration ratio (C/A) of the third additive (C) to the first additive (A) to be greater than 0 and 0.7 or less, and controlling a current density and a bath temperature to produce electrolytic copper in which a concentration of Ag is less than 0.2 mass ppm, a concentration of S is less than 0.1 mass ppm, a concentration of all impurities is less than 0.2 mass ppm, and an area ratio of crystal grains having an average crystal grain misorientation (GOS value) exceeding 2.5° is 10% or less.

The average crystal grain misorientation is a value obtained by obtaining crystal grain misorientations between a certain pixel in a crystal grain and all of the other pixels in the same crystal grain in one crystal grain and averaging these values, and the value thereof is a grain orientation spread (GOS) value. The description regarding the GOS value is disclosed in "Transactions of the Japan Society of Mechanical Engineers (A) Volume 71 Issue 712 (2005-12) Document No. 05-0367 (1722 to 1728)." In a case where there is misorientation of 5 degrees or greater between adjacent pixels, in crystal orientation analysis performed by an electron backscatter diffraction method, that portion is set as a grain boundary, and a region surrounded by the grain boundary is set as one crystal grain, as the crystal grain to be measured.

In the invention, the average crystal grain misorientation is referred to as a GOS value thereof. In a case where the GOS value is represented by a numerical expression, the GOS value can be represented by Expression [1], where a pixel number in the same crystal grain is n, respective numbers of different pixels in the same crystal grain are i and j ($1 \le i,j \le n$), and a crystal misorientation obtained from a crystal orientation in the pixel i and a crystal orientation in the pixel j is $\alpha ij$ ($i \neq j$).

[Expression 1]

$$GOS = \left( \sum_{i,j=1}^{n} \alpha_{ij(i \neq j)} \right) \Big/ n(n-1) \tag{1}$$

In the producing method of the invention, electrolytic copper in which an area ratio of crystal grains having a GOS value greater than 2.5° is 10% or less, preferably 8% or less, and more preferably 5% or less is produced. The presence of impurities is a reason for which the area ratio of crystal grains having a GOS value greater than 2.5° is more than 10%. The impurities during electrodeposition are incorporated into the crystal grain boundary and in the crystal grains and cause misorientation in the crystal grains, and the GOS value of the crystal grains is increased. In a case where the area ratio of crystal grains having a GOS value within 2.5° is 90% or more, this means that the electrolytic copper is homogeneous electrolytic copper having a small misorientation in the crystal grains and electrolytic copper in which the amount of impurities incorporated into the crystal grain boundary and in the crystal grain is small.

In addition, the area ratio of the crystal grains having a GOS value greater than 2.5° can be used as an index of occurrence of warpage of the electrolytic copper. Specifically, in a case where the area ratio is 20% or more, warpage occurs during the electrolysis, or in a case where the electrolytic copper is peeled off from a cathode plate, warpage is not observed, but warpage occurs after 12 hours. In contrast, in a case where the area ratio thereof is 10% or less, warpage does not occur in the electrolytic copper during the electrolysis, and warpage does not occur either in the electrolytic copper, even after 12 hours have elapsed.

In the producing method of the invention, electrolytic copper in which the area ratio of crystal grains having a GOS value greater than 2.5° is 10% or less, the concentration of Ag is less than 0.2 mass ppm, the concentration of S is less than 0.07 mass ppm, the concentration of all impurities is less than 0.2 mass ppm and more preferably less than 0.01 mass ppm is produced. The concentration of all impurities is a total amount of impurities excluding gas components (O, F, S, C, and Cl).

The GOS value of the electrolytic copper can be controlled by adding the first additive containing an aromatic ring of a hydrophobic group and a polyoxyalkylene group of a hydrophilic group, the second additive formed of polyvinyl alcohols, and the third additive formed of tetrazoles to a copper electrolyte, and performing copper electrolysis by adjusting each concentration of the first additive, the second additive, and the third additive in predetermined ranges, and adjusting a current density and a bath temperature during the copper electrolysis in predetermined ranges. As the copper electrolyte, copper sulfate or copper nitrate can be used.

The aromatic ring of the hydrophobic group of the first additive is a phenyl group or a naphthyl group, and examples thereof include monophenyl, naphthyl, cumyl, alkylphenyl, styrenated phenyl, distyrenated phenyl, tristyrenated phenyl, and tribenzylphenyl. The polyoxyalkylene group of the hydrophilic group of the first additive is, for example, a polyoxyethylene group or a polyoxypropylene group and may contain both a polyoxyethylene group and a polyoxypropylene group.

The aromatic ring is preferably a monophenyl group or a naphthyl group. In addition, the polyoxyalkylene group of the hydrophilic group is, for example, a polyoxyethylene group, a polyoxypropylene group, or a mixture of a polyoxyethylene group and a polyoxypropylene group, and particularly preferably a polyoxyethylene group.

Examples of a specific compound of the first additive include polyoxyethylene monophenyl ether, polyoxyethylene methyl phenyl ether, polyoxyethylene octyl phenyl ether, polyoxyethylene dodecyl phenyl ether, polyoxyethylene naphthyl ether, polyoxyethylene styrenated phenyl ether, polyoxyethylene distynylated phenyl ether, polyoxyethylene tristyrenated phenyl ether, polyoxyethylene cumyl phenyl ether, polyoxypropylene monophenyl ether, polyoxypropylene methyl phenyl ether, polyoxypropylene octyl phenyl ether, polyoxypropylene dodecyl phenyl ether, polyoxypropylene naphthyl ether, polyoxypropylene styrenated phenyl ether, polyoxypropylene distyrenated phenyl ether, polyoxypropylene tristyrenated phenyl ether, and polyoxypropylene cumyl phenyl ether.

The added number of moles of the polyoxyalkylene group of the hydrophilic group of the first additive is preferably 2 to 20 and more preferably 2 to 15. In a case where the added number of moles is 2 or more, the additive is easily dissolved in the electrolyte. In a case where the added number of moles is 20 or less, an attachment state of the additive to the anode surface does not become dense, it is possible to prevent excessive suppression of a dissolution reaction of the anode, and it is possible to prevent occurrence of anode slime and further improve the yield of electrolytic copper. In addition, in a case where the added number of moles is 20 or less, the dendrites are hardly generated on the surface of the electrolytic copper precipitated on the cathode, and smoothness is improved. Accordingly, the anode slime or S in the electrolyte is hardly attached and does not remain on the surface of the electrolytic copper, and purity of the electrolytic copper is further improved. In a case where the added number of moles of the polyoxyalkylene group of the additive is 2 to 20, the dissolution of the anode suitably proceeds, and accordingly, the content of anode slime decreases, compared to a case of using PEG or the like, and electrolytic copper having a high purity can be obtained. In addition, the additive containing the polyoxyalkylene group having the added number of moles of 2 to 15 can significantly reduce the content of S in the electrolytic copper.

Therefore, the first additive is preferably polyoxyalkylene monophenyl ether having the added number of moles of 2 to 20 or polyoxyalkylene naphthyl ether having the added number of moles of 2 to 20.

A saponification rate of polyvinyl alcohols of the second additive is preferably 70 to 99 mol %. In a case where the saponification rate is 70 mol % or more, an effect of relaxing an internal strain of the cathode during the electrodeposition is sufficient, and occurrence of warpage in the cathode during the electrodeposition or in the electrolytic copper after the electrodeposition can be reliably prevented. On the other hand, in a case where the saponification rate is 99 mol % or less, dissolubility is ensured and the second additive is easily dissolved in the electrolyte.

In addition, a weight average polymerization degree (hereinafter referred to as an average polymerization degree) of the second additive is preferably 200 to 2500. A basic structure of a polyvinyl alcohol and a derivative thereof is formed of a fully saponified type of a hydroxyl group and a partially saponified type of an acetic acid group, a polymerization degree is a total number of both, and an average polymerization degree is an average value of polymerization degrees. The average polymerization degree can be measured based on a polyvinyl alcohol test method based on JIS K 6726.

The second additive having an average polymerization degree of 200 or more has a comparatively simple structure and is generally used, and accordingly, is easily purchased. In addition, in a case where the average polymerization degree is 2500 or less, an effect of relaxing an internal strain of the cathode during the electrodeposition is sufficient, and occurrence of warpage in the cathode during the electrodeposition or in the electrolytic copper after the electrodeposition can be reliably prevented. Further, in a case where the average polymerization degree is 2500 or less, the electrodeposition prevention effect is hardly exhibited, and a decrease in yield of the electrolytic copper can be prevented. Therefore, the average polymerization degree of the second additive is more preferably 200 to 2000.

Tetrazoles of the third additive are tetrazole and a tetrazole derivative. As the tetrazole derivative, for example, an alkyl derivative of tetrazole, an amino derivative of tetrazole, or a phenyl derivative of tetrazole can be used. Specifically, as a silver chlorine reducing agent, 1H-tetrazole, 5-amino-1H-tetrazole, 5-methyl-1H-tetrazole, or 5-phenyl-1H-tetrazole can be used.

The additive amount of the first additive is preferably an amount at which a concentration is 10 mg/L to 500 mg/L and more preferably an amount at which a concentration is 40 mg/L to 200 mg/L. In a case where the additive amount of the first additive is less than 10 mg/L, an area ratio of crystal grains having a GOS value exceeding 2.5° is not easy to control to be 10% or less, and in a case where the additive amount thereof is greater than 500 mg/L, the effect is the same. In addition, in a case where the additive amount of the first additive is less than 10 mg/L, the surface of the electrolytic copper becomes rough and purity is decreased. In a case where the additive amount thereof is greater than 500 mg/L, the effect of the additive excessively increases, the slime generation amount from the anode increases, and the electrolytic copper easily warps. In addition, dendrites are generated and purity is decreased.

The additive amount of the second additive is preferably an amount at which a concentration is 1 mg/L to 100 mg/L and more preferably an amount at which a concentration is 10 mg/L to 50 mg/L. In a case where the additive amount of the second additive is less than 1 mg/L, the area ratio of crystal grains having a GOS value exceeding 2.5 is not easy to control to be 10% or less, and in a case where the additive amount thereof is greater than 100 mg/L, the area ratio of crystal grains having a GOS value exceeding 2.5 tends to be greater than 10%. In addition, in a case where the additive amount of the second additive is less than 1 mg/L, the electrolytic copper easily warps. In a case where the additive amount thereof is greater than 100 mg/L, in the electrolytic copper, dendrites are generated and purity is decreased.

The additive amount of the third additive is preferably an amount at which a concentration is 0.01 mg/L to 30 mg/L and more preferably an amount at which a concentration is 1 mg/L to 25 mg/L. In a case where the additive amount of the third additive is less than 0.01 mg/L, the area ratio of crystal grains having a GOS value exceeding 2.5 is not easy to control to be 10% or less, and in a case where the additive amount thereof is greater than 30 mg/L, the effect is the same.

In addition, in a case where the additive amount of the third additive is less than 0.01 mg/L, the effect of reducing a concentration of Ag in the electrolytic copper is poor, and in a case where the additive amount is greater than 30 mg/L, dendrites are easily generated in the electrolytic copper, and purity is decreased.

A concentration ratio (B/A) of the second additive (B) to the first additive (A) is preferably 0.1 to 0.8 and more preferably 0.13 to 0.65. In a case where this concentration ratio is less than 0.1, the area ratio of crystal grains having a GOS value exceeding 2.5 is not easy to control to be 10% or less, and in a case where the concentration ratio exceeds 0.8, the effect is the same.

The concentration ratio (C/A) of the third additive (C) to the first additive (A) is preferably greater than 0 and 0.7 or less and more preferably 0.001 to 0.5. In a case where this concentration ratio is less than 0.0001, the area ratio of crystal grains having a GOS value exceeding 2.5 is not easy to control to be 10% or less, and in a case where the concentration ratio exceeds 0.7, the effect is the same.

The first additive (A) containing an aromatic ring of a hydrophobic group and a polyoxyalkylene group of a hydrophilic group, the second additive (B) formed of polyvinyl alcohols, and the third additive (C) formed of tetrazoles are added to a copper electrolyte, and the copper electrolysis is performed by setting a concentration of the first additive (A) to be 10 mg/L to 500 mg/L, a concentration of the second additive (B) to be 1 mg/L to 100 mg/L, a concentration of the third additive (C) to be 0.01 mg/L to 30 mg/L, a concentration ratio (B/A) of the second additive (B) to the first additive (A) to be 0.1 to 0.8, and a concentration ratio (C/A) of the third additive (C) to the first additive (A) to be greater than 0 and 0.7 or less, and controlling a current density and a bath temperature, and accordingly, it is possible to produce electrolytic copper in which a concentration of Ag is less than 0.2 mass ppm, a concentration of S is less than 0.1 mass ppm, a concentration of all impurities is less than 0.2 mass ppm, and an area ratio of crystal grains having an average crystal grain misorientation (referred to as a GOS value) exceeding 2.5° is 10% or less.

In addition, the current density is set to be 150 A/m$^2$ to 190 A/m$^2$ and the bath temperature to be 30° C. to 35° C., and accordingly, it is possible to produce electrolytic copper in which a concentration of Ag is less than 0.15 mass ppm, a concentration of S is less than 0.07 mass ppm, a concentration of all impurities is less than 0.2 mass ppm, and an area ratio of crystal grains having an average crystal grain misorientation (GOS value) exceeding 2.5° is 10% or less.

Further, the concentration of the first additive (A) is set to be 40 mg/L to 200 mg/L, the concentration of the second additive (B) is set to be 10 mg/L to 50 mg/L, the concentration of the third additive (C) is set to be 0.1 mg/L to 25 mg/L, the concentration ratio (B/A) of the second additive (B) to the first additive (A) is set to be 0.1 to 0.65, and the concentration ratio (C/A) of the third additive (C) to the first additive (A) is set to be 0.001 and 0.5, and accordingly, it is possible to produce electrolytic copper in which a concentration of Ag is less than 0.1 mass ppm, a concentration of S is less than 0.02 mass ppm, a concentration of all impurities is less than 0.1 mass ppm, and an area ratio of crystal grains having an average crystal grain misorientation (GOS value) exceeding 2.5° is 8% or less.

Furthermore, the concentration of the second additive (B) is set to be 10 mg/L to 50 mg/L, the concentration of the third additive (C) is set to be 1 mg/L to 5 mg/L, the concentration ratio (B/A) of the second additive (B) to the first additive (A) is set to be 0.13 to 0.4, and the concentration ratio (C/A) of the third additive (C) to the first additive (A) is set to be 0.005 to 0.10, and accordingly, it is possible to produce electrolytic copper in which a concentration of Ag is less than 0.08 mass ppm, a concentration of S is less than 0.01 mass ppm, a concentration of all impurities is less than 0.1 mass ppm, and an area ratio of crystal grains having an average crystal grain misorientation (GOS value) exceeding 2.5° is 5% or less.

In the producing method of the invention, the current density is preferably 150 A/m$^2$ to 190 A/m$^2$ and the bath temperature is preferably 30° C. to 35° C. In a case where the bath temperature is 40° C., in the electrolytic copper, a concentration of Ag and a concentration of all impurities tend to increase.

In a case where the current density is excessively high or in a case where the bath temperature is excessively low, the electrolysis and the electrodeposition are not balanced, an interpolar voltage increases due to a passive state on the anode surface, the energization is not carried out, and electrolytic copper cannot be produced. For example, in the case of a copper sulfate electrolyte, crystals of the copper sulfate are generated on the anode surface, and accordingly, the entire surface of the anode is covered and the interpolar voltage is increased. In addition, in a case where the current density is excessively low, the electrodeposition speed becomes slow, and accordingly, a eutectoid amount of Ag is increased, and in a case where the bath temperature is excessively high, saturated solubility of Ag ions in the electrolyte increases, and accordingly, the eutectoid amount of Ag increases.

In the producing method of the invention, specifically, in a case where the current density is as low as approximately 140 $A/m^2$, the area ratio of the crystal grains having a GOS value greater than 2.5° is 15% or more, and in a case where the current density is high as approximately 200 $A/m^2$, the electrolysis cannot be performed. In addition, in a case where the bath temperature is as low as approximately 20° C., the electrolysis cannot be performed.

The electrolytic copper produced by the producing method of the invention having 10% or less of the area ratio of crystal grains having an average crystal grain misorientation (GOS value) exceeding 2.5°, preferably 8% or less, more preferably 5% or less, is electrolytic copper with no warpage. In addition, the amount of impurities mixed at the crystal grain boundary and into the crystal grains is small, and electrolytic copper having a high purity is obtained.

The electrolytic copper obtained by the producing method of the invention is high-purity electrolytic copper in which the concentration of Ag is less than 0.2 mass ppm, the concentration of S is less than 0.07 mass ppm, the concentration of all impurities is less than 0.2 mass ppm, the concentration of Ag is preferably 0.17 mass ppm or less, the concentration of S is preferably 0.051 mass ppm or less, and the concentration of all impurities is preferably less than 0.194 mass ppm or less, and accordingly, the electrolytic copper is suitable as a semiconductor material and can be broadly used in fields where a purity of 99.9999 mass % (6 N) or more is necessary.

According to the producing method of the invention, it is possible to produce electrolytic copper without warpage in which the area ratio of crystal grains having the GOS value exceeding 2.5° is 10% or less, by adding the first additive (A) containing an aromatic ring of a hydrophobic group and a polyoxyalkylene group of a hydrophilic group, the second additive (B) formed of polyvinyl alcohols, and the third additive (C) formed of tetrazoles to a copper electrolyte, and performing the copper electrolysis by controlling each concentration of the first additive (A), the second additive (B), and the third additive (C), the current density, and the bath temperature, each concentration of the first additive (A), the second additive (B), and the third additive (C) may be adjusted, and a large-scale change of equipment is not necessary, and therefore the method can be easily performed.

In the producing method of the invention, a balance of the electrodeposition is optimized, and accordingly, the anode dissolution is not excessively suppressed, a slime generation rate of anode decreases, the slime generation rate preferably becomes 25% or less, and the yield can be increased.

EXAMPLES

Hereinafter, examples of the invention are shown with comparative examples.

In the examples and the comparative examples, the GOS value was measured as follows.

Electrodeposited copper was peeled off from a cathode substrate, a center portion was cut to 3 cm on all sides, the cross section of this copper piece was processed by an ion milling method, measurement was performed in a measurement step of 3 μm in a TD direction by using an Electron Back Scatter Diffraction Patterns (EBSD; OM Data Collection manufactured by EDAX/TSL) device with FE-SEM (JSM-7001FA manufactured by JEOL Ltd.) attached, and analysis of the GOS value was performed using this measured data and analysis software (OIM Data Analysis ver. 5.2 manufactured by EDAX/TSL, analysis software for calculating the GOS value based on Expression [1]). A boundary between adjacent pixels having misorientation of 5° or more is assumed as a crystal grain boundary, misorientation between a certain pixel in a crystal grain and all of the other pixels in the crystal grain was calculated, the orientation was averaged, and a grain orientation spread (GOS) value was calculated.

The GOS value of all crystal grains in the square having a size of 3 cm×3 cm was calculated, the area ratio of crystal grains having a GOS value exceeding 2.5° was obtained, and is shown as the "area ratio based on GOS value [%]" in Table 1.

The evaluation of "x" in Table 1 shows that the electrolytic copper was warped and dropped from the cathode substrate during the electrolysis test and the electrolysis test could not be continued.

Regarding the concentration of S, the concentration of Ag, and the concentration of all impurities excluding gas components in the electrolytic copper, the measurement sample was collected from the center portion of the produced electrolytic copper, and contents of Ag, Al, As, Au, B, Ba, Be, Bi, C, Ca, Cd, Cl, Co, Cr, F, Fe, Ga, Ge, Hg, In, K, Li, Mg, Mn, Mo, Na, Nb, Ni, O, P, Pb, Pd, Pt, S, Sb, Se, Si, Sn, Te, Th, Ti, U, V, W, Zn, and Zr were measured by using a GD-MS device (VG-9000 manufactured by VG MICROTRACE). Among these, the content of all components excluding gas components (O, F, S, C, and Cl) was added and set as a total amount of impurities.

The slime generation rate (%) of the anode was obtained by Expression [2].

$$\text{slime generation rate (\%)}=[\{(\text{weight before anode electrodeposition}-\text{weight after anode electrodeposition})-\text{cathode electrodeposition weight}\}/(\text{weight before anode electrodeposition}-\text{weight after anode electrodeposition})]\times 100 \quad [2]$$

The slime generation rate obtained in each example and comparative example is shown in Table 1.

The evaluation of "x" in Table 1 shows that the electrolytic copper was warped and dropped from the cathode substrate during the electrolysis test and the electrolysis test could not be continued.

The warpage of the electrolytic copper was determined by visual observation. A case where the electrolytic copper was warped and dropped from the cathode substrate during the electrolysis, and a case where the cathode was pulled up after the completion of the electrolysis test, and the entire surface of cathode substrate and the entire surface of the electrolytic copper were not adhered at this point and were partially peeled off were determined as "C".

In a case where the cathode pulled up after completion of the electrolysis was visually observed, tests Nos. 1 to 3 of Table 1 in which the cathode substrate and the electrolytic copper were partially peeled off were evaluated as "C," and Tests Nos. 25 and 26 in which the electrolytic copper was warped and dropped off from the cathode substrate during the electrolysis test were determined as "C."

Regarding a case where the entire surface of the cathode substrate and the entire surface of the electrolytic copper were not adhered, the electrolytic copper was peeled off from the cathode substrate, and the peeled surface was put on the bottom, the electrolytic copper was left on a desk. The electrolytic copper was flat immediately after it was left on the desk. A case where the state of the electrolytic copper changed from the flat state to the warped state within 12 hours from the above point was evaluated as "B," and a case where the state did not change was evaluated as "A."

As the copper electrolyte, a copper sulfate electrolyte having a concentration of sulfuric acid of 50 g/L, a concentration of copper sulfate pentahydrate of 197 g/L, and a concentration of chloride ions of 50 mg/L were used. The following compounds were used as the first additive (additive A), the second additive (additive B), and the third additive (additive C), and amounts of these at which the concentrations were as shown in Table 1 were added to the copper electrolyte.

<First Additive A>

A-1: Polyoxyethylene monophenyl ether in which added number of moles of ethylene oxide is 5 (manufactured By Nippon Nyukazai Co., Ltd., PgG-55)

A-2: Polyoxyethylene naphthyl ether in which added number of moles of ethylene oxide is 10 (manufactured by DKS Co. Ltd., NOIGEN EN-10)

A-3: Polyethylene glycol having average molecular weight of 1500 (manufactured by KANTO KAGAKU)

<Second Additive B>

B-1: Polyvinyl alcohol having a saponification rate of 98.5 mol % and average polymerization degree of 500 (manufactured by Nippon Synthetic Chem Industry Co., Ltd., Gohsenol NL-05)

B-2: Polyvinyl alcohol having a saponification rate of 99 mol % and average polymerization degree of 1200 (manufactured by Nippon Synthetic Chem Industry Co., Ltd., Gohsenol NL-11)

B-3: Carboxy-modified polyvinyl alcohol having a saponification rate of 85 mol % and average polymerization degree of 250 (SD-1000 manufactured by Kuraray Co., Ltd.)

B-4: Polyvinyl alcohol having a saponification rate of 94.5 mol % and average polymerization degree of 3300 (JM-33 manufactured by Japan Vam & Poval Co., Ltd.)

<Third Additive C>

C-1: 1H-Tetrazole (manufactured by Tokyo Chemical Industry)

C-2: 5-Amino-1H-tetrazole (manufactured by Tokyo Chemical Industry)

C-3: 5-Methyl-1H-tetrazole (manufactured by Tokyo Chemical Industry)

As the anode, electrolytic copper having a purity of 99.99 mass % (4 N) was used, and the slime generated from the anode was prevented from being included in the cathode by using an anode bag. As the cathode, a plate of SUS 316 was used, and in order to prevent current concentration on an end portion, the electrodeposition was evenly performed by edge masking (manufactured by Materials Eco-Refining Co., Ltd., Snapjaws™). In addition, a preliminary test was performed in advance, a consumption rate of each additive was calculated, and an additive supply solution was produced, and the copper electrolysis was performed for 7 days, while constantly sending the additive supply solution with a tube pump, and while removing particles and the like from the electrolyte with a filter having filtering accuracy of 0.5 μm, by setting the current density to 140 to 200 A/m$^2$ and the bath temperature to 20° C. to 40° C. The measurement of additives A, B, and C was performed every 48 hours. Each concentration of additives A and B was measured with an ultraviolet detector of HPLC using an ODS column, a concentration of the additive C was measured by a corona charge detector of HPLC using a GPC column, and the concentration of the additives was corrected so that the concentration did not change from the initial concentration by 20% or more. The effects of copper electrolysis are shown in Tables 1 and 2.

As shown in Tables 1 and 2, in samples Nos. 1 to 4 in which the second additive (B) or the third additive (C) was not used, the area ratio of crystal grains having a GOS value exceeding 2.5° was 20% or more, and accordingly, warpage of the electrolytic copper occurred during the electrolysis and homogeneity of crystals was low. In addition, in sample No. 7 in which the first additive (A) was polyethylene glycol, the area ratio was 20% or more, and accordingly, warpage of the electrolytic copper occurred and homogeneity of crystals was low, the concentration of S was greater than 0.07 mass ppm, and the concentration of all impurities in most portions was greater than 0.2 mass ppm.

In sample No. 8 in which the second additive (B) was polyvinyl alcohol having an average polymerization degree of 3300, an effect of relaxing an internal stress strain was low due to the high average polymerization degree, and the area ratio was more than 10%, and accordingly, warpage of the electrolytic copper occurred and homogeneity of crystals was low.

In sample No. 9 in which the additive amount of the second additive (B) was small and sample No. 10 in which the additive amount of the second additive (B) was excessively great, the area ratio was more than 10%, and accordingly, warpage of the electrolytic copper occurred, homogeneity of crystals was low, the concentration of S was greater than 0.07 mass ppm, and the concentration of all impurities was greater than 0.2 mass ppm.

The samples Nos. 5 and 6 did not contain the third additive, and accordingly, the area ratio of crystal grains having a GOS value exceeding 2.5° was 10% or less, but was close to the reference value of 10%, the concentration of S was greater than 0.07 mass ppm, and the concentration of all impurities was greater than 0.2 mass ppm.

In samples Nos. 11 to 23 and 27 (examples of the invention), the area ratio was 10% or less, warpage of the electrolytic copper did not occur during the electrolysis, and homogeneity of crystals was high. In addition, high-purity electrolytic copper in which the concentration of Ag was 0.17 mass ppm or less, the concentration of S was 0.051 mass ppm or less, and the concentration of all impurities was 0.194 mass ppm or less was obtained. Further, the slime generation rate was 30% or less, and in the samples Nos. 21 to 23 and 27, the slime generation rate was 20% or less.

In the sample No. 27, the bath temperature of the electrolyte was comparatively high at 40° C., and the concentration of Ag was greater than 0.15 mass ppm.

Meanwhile, in the sample No. 24, the current density was excessively low (140 A/m$^2$), and accordingly, the area ratio of crystal grains having a GOS value exceeding 2.5° was greater than 15%, and in the sample No. 25, the current density was excessively high (200 A/m$^2$), the electrolytic copper was warped and dropped from the cathode substrate during the electrolysis test, and the electrolysis test could not be continued. In addition, in the test No. 26, the bath temperature of the electrolyte was excessively low (20° C.), the electrolytic copper was warped and dropped from the cathode substrate during the electrolysis test, and the electrolysis test could not be continued.

TABLE 1

| No. | Acid type | Current density [A/m2] | Bath temperature [° C.] | Additive A Type | Additive A Concentration [mg/L] | Additive B Type | Additive B Concentration [mg/L] | Additive C Type | Additive C Concentration [mg/L] | Concentration ratio B/A | Concentration ratio C/A | Area ratio based on GOS value [%] | Slime generation rate [%] | Warpage of electrolytic copper |
|---|---|---|---|---|---|---|---|---|---|---|---|---|---|---|
| 1 | Sulfuric acid | 175 | 30 | A-3 | 80 | None | | | | 0.00 | 0 | 25.4 | 36.8 | C |
| 2 | Sulfuric acid | 175 | 30 | A-1 | 80 | None | | | | 0.00 | 0 | 26.1 | 23.1 | C |
| 3 | Nitric acid | 175 | 30 | A-2 | 80 | None | | | | 0.00 | 0 | 24.8 | 20.5 | C |
| 4 | Sulfuric acid | 175 | 30 | A-2 | 80 | B-3 | 20 | None | | 0.25 | 0 | 22.3 | 32.1 | B |
| 5 | Sulfuric acid | 175 | 30 | A-2 | 80 | B-1 | 20 | None | | 0.25 | 0 | 9.8 | 22.4 | A |
| 6 | Nitric acid | 175 | 30 | A-1 | 80 | B-2 | 20 | None | | 0.25 | 0 | 8.7 | 23.1 | A |
| 7 | Sulfuric acid | 175 | 30 | A-3 | 80 | B-2 | 20 | C-1 | 4 | 0.25 | 0.05 | 27.1 | 38.1 | B |
| 8 | Sulfuric acid | 175 | 30 | A-2 | 80 | B-4 | 20 | C-2 | 4 | 0.25 | 0.05 | 17.2 | 34.1 | B |
| 9 | Nitric acid | 175 | 30 | A-2 | 80 | B-1 | 0.1 | C-2 | 4 | 0.00 | 0.05 | 16.8 | 29.6 | B |
| 10 | Sulfuric acid | 175 | 30 | A-2 | 80 | B-2 | 110 | C-3 | 4 | 1.38 | 0.05 | 20.1 | 30.1 | B |
| 11 | Sulfuric acid | 175 | 30 | A-1 | 120 | B-1 | 20 | C-3 | 0.01 | 0.17 | 8.33E−05 | 6.6 | 24.3 | A |
| 12 | Sulfuric acid | 175 | 30 | A-1 | 40 | B-1 | 20 | C-1 | 25 | 0.50 | 0.625 | 6.1 | 28.5 | A |
| 13 | Sulfuric acid | 175 | 35 | A-2 | 80 | B-1 | 50 | C-2 | 2 | 0.63 | 0.025 | 7.8 | 22.1 | A |
| 14 | Sulfuric acid | 175 | 30 | A-1 | 80 | B-2 | 20 | C-3 | 0.3 | 0.25 | 0.00375 | 6.5 | 20.7 | A |
| 15 | Nitric acid | 175 | 30 | A-1 | 80 | B-1 | 20 | C-2 | 15 | 0.25 | 0.1875 | 5.3 | 25.6 | A |
| 16 | Sulfuric acid | 175 | 30 | A-2 | 100 | B-1 | 20 | C-3 | 15 | 0.20 | 0.15 | 3.8 | 24.6 | A |
| 17 | Sulfuric acid | 175 | 30 | A-1 | 100 | B-1 | 50 | C-2 | 4 | 0.50 | 0.04 | 4.5 | 22.8 | A |
| 18 | Sulfuric acid | 175 | 30 | A-2 | 80 | B-2 | 10 | C-1 | 1 | 0.13 | 0.0125 | 1.2 | 21.6 | A |
| 19 | Sulfuric acid | 175 | 30 | A-2 | 120 | B-2 | 20 | C-2 | 2 | 0.17 | 0.016667 | 0.5 | 20.2 | A |
| 20 | Sulfuric acid | 150 | 35 | A-2 | 120 | B-2 | 20 | C-2 | 2 | 0.17 | 0.016667 | 6.8 | 20.2 | A |
| 21 | Sulfuric acid | 190 | 10 | A-2 | 120 | B-2 | 20 | C-2 | 2 | 0.17 | 0.016667 | 0.4 | 19.8 | A |
| 22 | Sulfuric acid | 175 | 30 | A-1 | 160 | B-1 | 30 | C-2 | 3 | 0.19 | 0.01875 | 1 | 18.7 | A |
| 23 | Sulfuric acid | 175 | 30 | A-1 | 200 | B-1 | 40 | C-3 | 4 | 0.20 | 0.02 | 0.6 | 19.6 | A |
| 24 | Sulfuric acid | 140 | 30 | A-2 | 120 | B-2 | 20 | C-2 | 2 | 0.17 | 0.016667 | 15.2 | 20.4 | A |
| 25 | Sulfuric acid | 200 | 30 | A-2 | 120 | B-2 | 20 | C-2 | 2 | 0.17 | 0.016667 | × | × | C |
| 26 | Sulfuric acid | 175 | 20 | A-2 | 120 | B-2 | 20 | C-2 | 2 | 0.17 | 0.016667 | × | × | C |
| 27 | Sulfuric | 175 | 40 | A-2 | 120 | B-2 | 20 | C-2 | 2 | 0.17 | 0.016667 | 7.1 | 19.8 | A |

(Note)

The area ratio based on GOS value is the area ratio of crystal grains having a GOS value exceeding 2.5°

In the box of warpage of the electrolytic copper, C indicates a state where warpage occurred during electrolysis, B indicates a state where warpage was not observed in a case where the electrolytic copper was peeled off from the cathode plate, but warpage occurred after 12 hours, and A indicates a state where warpage did not occur during electrolysis, and warpage did not occur 12 hours after the electrolysis.

TABLE 2

| | Electrolytic copper | | |
|---|---|---|---|
| No | S [mass ppm] | Ag [mass ppm] | All impurities [mass ppm] |
| 1 | 1.15 | 0.35 | 0.375 |
| 2 | 0.214 | 0.21 | 0.263 |
| 3 | 0.165 | 0.26 | 0.274 |
| 4 | 0.121 | 0.15 | 0.175 |
| 5 | 0.089 | 0.19 | 0.232 |
| 6 | 0.075 | 0.21 | 0.251 |
| 7 | 0.861 | 0.25 | 0.288 |
| 8 | 0.032 | 0.11 | 0.137 |
| 9 | 0.075 | 0.19 | 0.211 |
| 10 | 0.081 | 0.18 | 0.209 |
| 11 | 0.051 | 0.12 | 0.145 |
| 12 | 0.024 | 0.13 | 0.164 |
| 13 | 0.015 | 0.08 | 0.099 |
| 14 | 0.011 | 0.07 | 0.095 |
| 15 | 0.01 | 0.07 | 0.097 |
| 16 | 0.016 | 0.05 | 0.075 |
| 17 | 0.012 | 0.06 | 0.081 |
| 18 | 0.006 | 0.04 | 0.071 |
| 19 | 0.004 | 0.02 | 0.059 |
| 20 | 0.006 | 0.08 | 0.099 |
| 21 | 0.009 | 0.03 | 0.065 |
| 22 | 0.008 | 0.03 | 0.061 |
| 23 | 0.004 | 0.05 | 0.073 |
| 24 | 0.007 | 0.16 | 0.185 |
| 25 | — | — | — |
| 26 | — | — | — |
| 27 | 0.008 | 0.17 | 0.194 |

The invention claimed is:

1. A method for producing high-purity electrolytic copper, comprising:

Preparing a copper electrolyte using copper sulfate;

adding a first additive (A) containing an aromatic ring of a hydrophobic group and a polyoxyalkylene group of a hydrophilic group, a second additive (B) formed of polyvinyl alcohols, and a third additive (C) formed of tetrazoles to the copper electrolyte; and performing copper electrolysis by setting a concentration of the first additive (A) to be 10 mg/L to 500 mg/L, a concentration of the second additive (B) to be 1 mg/L to 100 mg/L, a concentration of the third additive (C) to be 0.01 mg/L to 5 mg/L, a concentration ratio (B/A) of the second additive (B) to the first additive (A) to be 0.1 to 0.8, and a concentration ratio (C/A) of the third additive (C) to the first additive (A) to be greater than 0 and 0.7 or less, and controlling a current density and a bath temperature to produce electrolytic copper in which a concentration of Ag is less than 0.2 mass ppm, a concentration of S is less than 0.1 mass ppm, a concentration of all impurities is less than 0.2 mass ppm, and an area ratio of crystal grains having an average crystal grain misorientation (referred to as a GOS value) exceeding 2.5° is 10% or less, wherein the third additive (C) is one or more of the tetrazoles selected from a group consisting of 5-methyl-1H-tetrazole and 5-phenyl-1H-tetrazole.

2. The method for producing high-purity electrolytic copper according to claim 1, comprising:

performing copper electrolysis by setting the current density to be 150 A/m$^2$ to 190 A/m$^2$ and the bath temperature to be 30° C. to 35° C. to produce electrolytic copper in which the concentration of Ag is less than 0.15 mass ppm, the concentration of S is less than 0.07 mass ppm, the concentration of all impurities is less than 0.2 mass ppm, and the area ratio of crystal grains having an average crystal grain misorientation (GOS value) exceeding 2.5° is 10% or less.

3. The method for producing high-purity electrolytic copper according to claim 1, comprising:

setting the concentration of the first additive (A) to be 40 mg/L to 200 mg/L, the concentration of the second additive (B) to be 10 mg/L to 50 mg/L, the concentration of the third additive (C) to be 0.1 mg/L to 5 mg/L, the concentration ratio (B/A) of the second additive (B) to the first additive (A) to be 0.1 to 0.65, and the concentration ratio (C/A) of the third additive (C) to the first additive (A) to be 0.001 to 0.5 to produce electrolytic copper in which the concentration of Ag is less than 0.1 mass ppm, the concentration of S is less than 0.02 mass ppm, the concentration of all impurities is less than 0.1 mass ppm, and the area ratio of crystal grains having an average crystal grain misorientation (GOS value) exceeding 2.5° is 8% or less.

4. The method for producing high-purity electrolytic copper according to claim 1, comprising:

setting the concentration of the second additive (B) to be 10 mg/L to 50 mg/L, the concentration of the third additive (C) to be 1 mg/L to 5 mg/L, the concentration ratio (B/A) of the second additive (B) to the first additive (A) to be 0.13 to 0.4, and the concentration ratio (C/A) of the third additive (C) to the first additive (A) to be 0.005 to 0.10 to produce electrolytic copper in which the concentration of Ag is less than 0.08 mass ppm, the concentration of S is less than 0.01 mass ppm, the concentration of all impurities is less than 0.1 mass ppm, and the area ratio of crystal grains having an average crystal grain misorientation (GOS value) exceeding 2.5° is 5% or less.

5. The method for producing high-purity electrolytic copper according to claim 2, comprising:

setting the concentration of the first additive (A) to be 40 mg/L to 200 mg/L, the concentration of the second additive (B) to be 10 mg/L to 50 mg/L, the concentration of the third additive (C) to be 0.1 mg/L to 5 mg/L, the concentration ratio (B/A) of the second additive (B) to the first additive (A) to be 0.1 to 0.65, and the concentration ratio (C/A) of the third additive (C) to the first additive (A) to be 0.001 to 0.5 to produce electrolytic copper in which the concentration of Ag is less than 0.1 mass ppm, the concentration of S is less than 0.02 mass ppm, the concentration of all impurities is less than 0.1 mass ppm, and the area ratio of crystal grains having an average crystal grain misorientation (GOS value) exceeding 2.5° is 8% or less.

6. The method for producing high-purity electrolytic copper according to claim 2, comprising:

setting the concentration of the second additive (B) to be 10 mg/L to 50 mg/L, the concentration of the third additive (C) to be 1 mg/L to 5 mg/L, the concentration ratio (B/A) of the second additive (B) to the first additive (A) to be 0.13 to 0.4, and the concentration ratio (C/A) of the third additive (C) to the first additive (A) to be 0.005 to 0.10 to produce electrolytic copper in which the concentration of Ag is less than 0.08 mass ppm, the concentration of S is less than 0.01 mass ppm, the concentration of all impurities is less than 0.1 mass ppm, and the area ratio of crystal grains having an average crystal grain misorientation (GOS value) exceeding 2.5° is 5% or less.

7. The method for producing high-purity electrolytic copper according to claim 2, wherein the current density is 175 $A/m^2$ to 190 $A/m^2$.

8. The method for producing high-purity electrolytic copper according to claim 1, the GOS value is represented by an expression (1), $$GOS = \left( \sum_{i,j-1}^{n} \alpha_{ij(i \neq j)} \right) / n(n-1) \quad (1)$$

wherein, in the expression (1), a pixel number in the same crystal grain is n, respective numbers of different pixels in the same crystal grain are i and j ($1 \leq i, j \leq n$), and a crystal misorientation obtained from a crystal orientation in the pixel i and a crystal orientation in the pixel j is $\alpha ij$ ($i \neq j$).

* * * * *